US007870953B2

(12) United States Patent
Tanbo et al.

(10) Patent No.: US 7,870,953 B2
(45) Date of Patent: Jan. 18, 2011

(54) CIGARETTE PACKAGE

(75) Inventors: Hitoshi Tanbo, Tokyo (JP); Sadayoshi Matsuura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 153 days.

(21) Appl. No.: 11/785,519

(22) Filed: Apr. 18, 2007

(65) Prior Publication Data

US 2007/0193892 A1 Aug. 23, 2007

Related U.S. Application Data

(63) Continuation of application No. PCT/JP2005/019014, filed on Oct. 17, 2005.

(30) Foreign Application Priority Data

Oct. 19, 2004 (JP) ..... 2004-304157

(51) Int. Cl.
*B65D 85/10* (2006.01)
*B65D 85/00* (2006.01)
*B65D 81/24* (2006.01)

(52) U.S. Cl. ..... 206/268; 206/273; 206/459.5; 206/232

(58) Field of Classification Search ..... 206/268, 206/242, 259, 459.5, 256, 265, 232, 205, 206/257, 264, 271, 273; 229/87.12–87.14
See application file for complete search history.

(56) References Cited

U.S. PATENT DOCUMENTS

| | | | | |
|---|---|---|---|---|
| 3,616,190 | A * | 10/1971 | Shaw | 428/35.3 |
| 3,695,422 | A * | 10/1972 | Tripodi | 206/232 |
| 4,717,017 | A | 1/1988 | Sprinkel, Jr. et al. | |
| 4,720,423 | A | 1/1988 | Fraser | |
| 5,150,720 | A | 9/1992 | Focke et al. | |
| 5,249,676 | A * | 10/1993 | Ashcraft et al. | 206/264 |
| 5,277,304 | A * | 1/1994 | Brizzi et al. | 206/256 |
| 5,439,105 | A * | 8/1995 | Focke | 206/268 |
| 6,000,539 | A * | 12/1999 | Stewart-Cox et al. | 206/264 |
| 6,244,017 | B1 * | 6/2001 | Focke et al. | 53/147 |
| 6,478,149 | B1 * | 11/2002 | Parker | 206/273 |
| 6,513,651 | B1 | 2/2003 | Focke et al. | |
| 6,612,429 | B2 * | 9/2003 | Dennen | 206/268 |
| 6,742,651 | B1 * | 6/2004 | Focke et al. | 206/268 |
| 7,331,451 | B2 * | 2/2008 | Focke et al. | 206/264 |

FOREIGN PATENT DOCUMENTS

| | | |
|---|---|---|
| CH | 690005 A5 | 3/2000 |
| DE | 102 08 026 A1 | 9/2003 |
| EP | 1312564 A1 | 5/2003 |
| GB | 341264 | 1/1931 |
| JP | 63-68878 A | 3/1988 |

(Continued)

*Primary Examiner*—Mickey Yu
*Assistant Examiner*—Steven A. Reynolds
(74) *Attorney, Agent, or Firm*—Birch Stewart Kolasch & Birch, LLP

(57) ABSTRACT

A cigarette package having an inner pack of a cigarette bundle, an inner box containing the inner pack in a sealed state, a hinge-lid outer box containing the inner box, a containing space secured between the outer box and the inner box by using an outer blank for the outer box, and a printed article in a folded state, which is disposed in the containing space.

10 Claims, 6 Drawing Sheets

FOREIGN PATENT DOCUMENTS

| | | | |
|---|---|---|---|
| JP | 63-248674 | A | 10/1988 |
| JP | 4-215940 | A | 8/1992 |
| JP | 10-258881 | A | 9/1998 |
| JP | 11-222228 | A | 8/1999 |
| JP | 2001-524429 | A | 12/2001 |
| JP | 2002-516237 | A | 6/2002 |
| JP | 2002-524361 | A | 8/2002 |
| JP | 2002-262851 | A | 9/2002 |
| RU | 2002 132 195 | | 7/2004 |
| UA | 28077 | C2 | 10/2000 |
| UA | 6 862 | U | 5/2005 |
| UA | 74664 | C2 | 1/2006 |
| WO | WO-96/09230 | A1 | 3/1996 |
| WO | WO-01/83326 | A1 | 11/2001 |

* cited by examiner

CIGARETTE PACKAGE

This application is a Continuation of copending PCT International Application No. PCT/JP2005/019014 filed on Oct. 17, 2005, which designated the United States, and on which priority is claimed under 35 U.S.C. §120. This application also claims priority under 35 U.S.C. §119(a) on Patent Application No(s). 2004-304157 filed in Japan on Oct. 19, 2004. The entire contents of each of the above documents is hereby incorporated by reference.

TECHNICAL FIELD

The present invention relates to a cigarette package with printed articles including advertising media, an explanatory note about smoking, a coupon, etc.

BACKGROUND ART

A cigarette package of this type is disclosed, for example, in Published Japanese Translation No. 2002-516237 of PCT International Publication. The cigarette package disclosed in this gazette includes a coupon as a printed article. The coupon is interposed between the outer casing of the cigarette package and a transparent film in which the outer casing is wrapped.

The outer casing described in this gazette is formed of an outer wrapper for wrapping an inner pack. The inner pack includes a cigarette bundle and an inner wrapper such as aluminum-vapor-deposited paper in which the cigarette bundle is wrapped.

The wrappers are folded around their respective objective articles, that is, the inner pack and the cigarette bundle, and form the outer casing and the inner pack, respectively. The folds of the wrappers provide lapping portions that overlap with each other. As these lapping portions are simply partially bonded to each other, there are many gaps in the outer casing and the inner pack.

Since the coupon interposed between the outer casing and the transparent film is a printed article, the cigarette bundle, namely cigarettes or filter cigarettes, absorb the odor of ink from the coupon through the gaps of the outer casing and the inner pack. This spoils the original aroma and flavor of the cigarettes.

The coupon covers a part of the outer surface of the outer casing, so that the consumer hardly notices the information printed on the outer surface of the outer wrapper.

Apart from the soft package disclosed in the above-mentioned gazette, the same problem occurs with a hard package with a hinge lid.

It is an object of the present invention to provide a cigarette package in which the quality of a cigarette bundle is prevented from being degraded by an ink odor emitted from printed articles such as coupons, and in which an outer surface of the cigarette package is not covered with the printed articles.

DISCLOSURE OF THE INVENTION

In order to achieve the above-mentioned object, a cigarette package of the present invention comprises an inner pack obtained by wrapping a cigarette bundle in inner wrapping paper, an openable/closable inner box air-tightly containing the inner pack, a hinge-lid outer box containing the inner box and securing a containing space in between an inner surface of the outer box and the inner box, and a printed article contained in the containing space so as to be removable from the outer box.

According to the cigarette package, when a lid of the outer box is first opened, the printed article is removed from the outer box. Subsequently, when the inner box is opened, each cigarette or filter cigarette of the cigarette bundle can be drawn from the inner pack.

Since the inner pack, or cigarette bundle, is contained in the inner box in a sealed state, the ink odor emitted from the printed article does not enter the inner box. Therefore, the ink odor does not permeate the cigarette bundle during the period from the fabrication of the cigarette package to the moment when the inner box is opened for the first time. Consequently, the quality of the cigarette bundle can be retained well for a long period of time. Since the printed article is contained in the containing space located inside the outer box, the printed article never hides information printed on the outer surface of the outer box by covering the outer surface.

The inner box includes an inner blank folded around the inner pack. The inner blank can be heat-sealed and has shielding performance against aroma and flavor components released from the cigarette bundle. Specifically, the inner blank has a shielding layer made of aluminum and resin layers laminated on both sides of the shielding layer and can be heat-sealed. This inner blank not only prevents the ink odor emitted from the printed article from entering the inner box but also prevents the aroma and flavor components released from the cigarette bundle from escaping outside the inner box.

The outer box includes a box body formed by folding a paper outer blank around the inner box and the printed article. The box body has an upper end opened, and a hinge lid for opening/closing the opening of the box body. To be concrete, the box body has a front wall, right and left side walls, a rear wall and a bottom wall. The containing space is defined by the front wall, the side walls, the bottom wall, and a front face of the inner box.

Each of the side walls of the box body is formed into a double structure having an outside part and an inside part. The inside parts define sides of the containing space, and have bent portions bent toward the printed article. In this case, the inside parts of the side walls further have fold lines for demarcating the respective bent portions. The bent portions are bent along the fold lines when the outer blank is folded. In this case, simply by modifying the outer blank, there is secured the containing space for the printed article between the outer and inner boxes.

The cigarette package may further include a lot of aroma capsules arranged in the containing space. These aroma capsules rupture when the printed article is removed from the outer box, and release the aroma and flavor components. Preferably, the aroma capsules release, for example, the same aroma and flavor components as those released from the cigarette bundle. By so doing, the smoker can enjoy the aroma and flavor generated from the cigarette bundle before opening the inner box.

Specifically, the aroma capsules are bonded to both the inner surface of the outer box and the printed article by using an adhesive agent. The adhesive agent causing the aroma capsules to break when the printed article is removed from the outer box.

BEST MODE OF CARRYING OUT THE INVENTION

Figure 1:
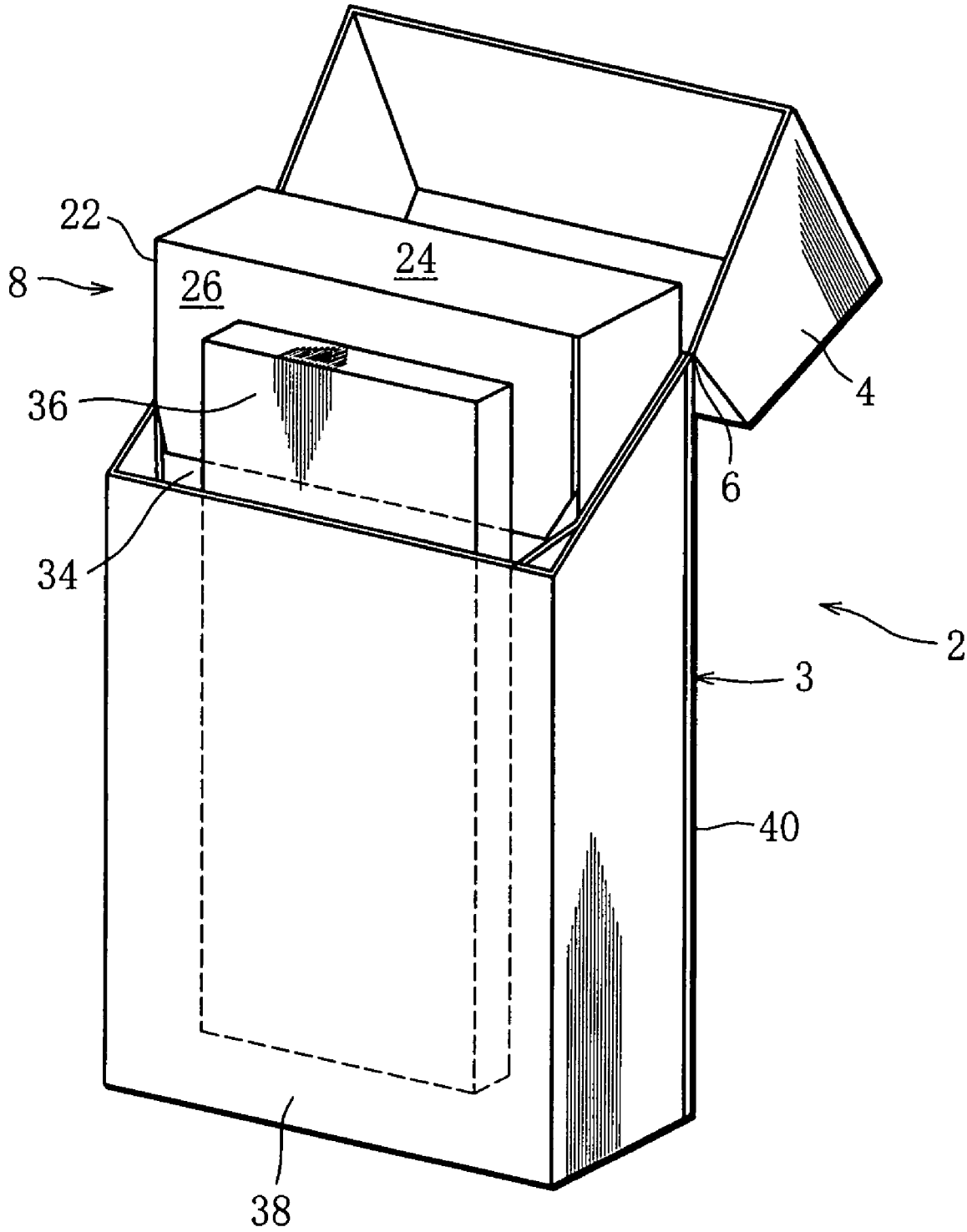
FIG. 1 is a perspective view showing a cigarette package according to one embodiment.

A cigarette package shown in FIG. 1 comprises a hinge-lid outer box 2. The outer box 2 is produced by folding an outer blank made of paper. The outer box 2 includes a box body 3 having an opening in an upper end thereof, and a lid 4 for opening/closing the opening of the box body 3. The lid 4 is connected to a rear face of the box body 3 through a self hinge 6 and is rotatable around the self hinge 6.

The cigarette package may include a transparent film for wrapping the outer box 2. If so, the transparent film has a tear tape.

Figure 2:
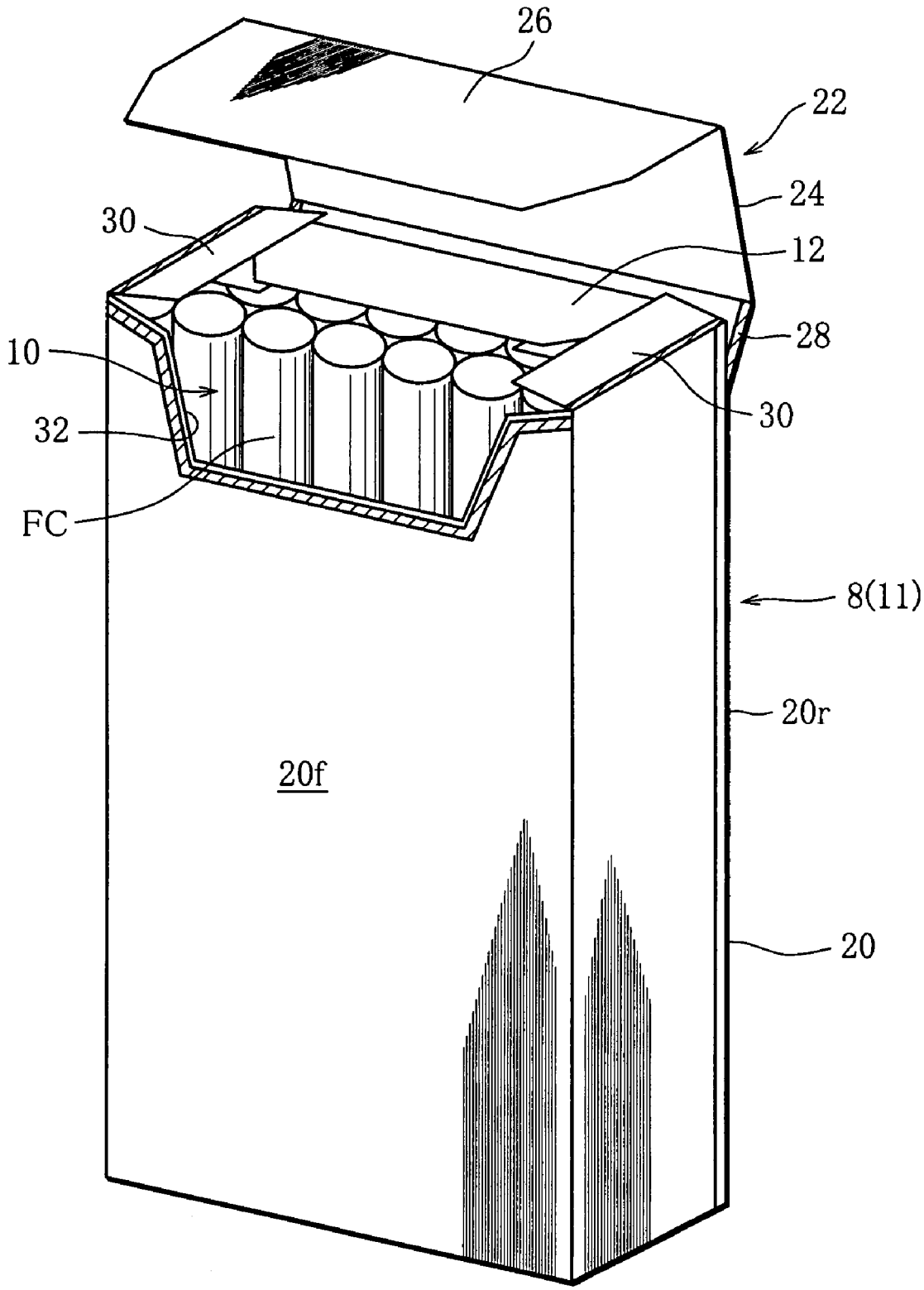
FIG. 2 is a perspective view showing an inner casing contained in the cigarette package of FIG. 1.
Figure 3:
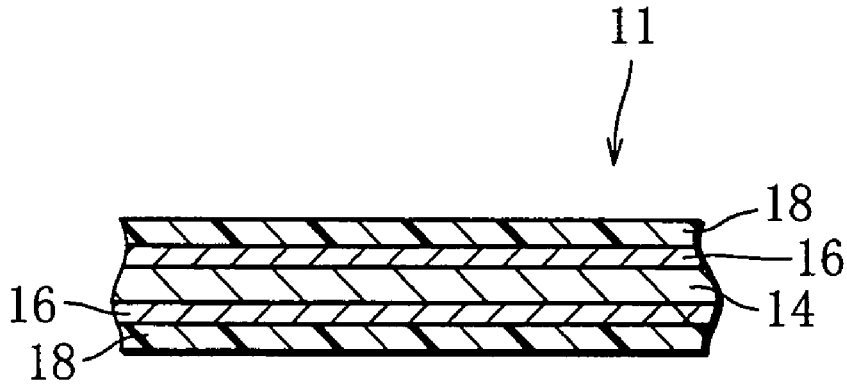
FIG. 3 is a sectional view of an inner blank for forming the inner casing of FIG. 2.

A tongue-lid inner box 8 is contained in the outer box 2. As illustrated in FIG. 2, the inner box 8 contains an inner pack 10 therein in a sealed state. The inner pack 10 includes a cigarette bundle formed of, for example, twenty filter cigarettes FC, and an inner wrapper, namely soft aluminum-vapor-deposited paper 12, for wrapping the cigarette bundle. The aluminum-vapor-deposited paper 12 has a thin base material made of paper or the like and a deposited aluminum film formed on an outer surface of the base material. The aluminum-vapor-deposited paper 12 has a cut-off section in a portion thereof. The cut-off section is demarcated by a cutoff line. As illustrated in FIG. 2, when the inner box 8 is opened, and the cut-off section of the aluminum-vapor-deposited paper 12 is cut off along the cutoff line, the cigarette bundle is partially exposed from the opening of the inner pack 10.

The inner box 8 is produced by folding an inner blank 11 around the inner pack 10. The inner blank 11 can be heat-sealed. The folding of the inner blank 11 provides lapping portions that overlap with each other. The lapping portions are bonded to each other by being heat-sealed.

Figure 4:
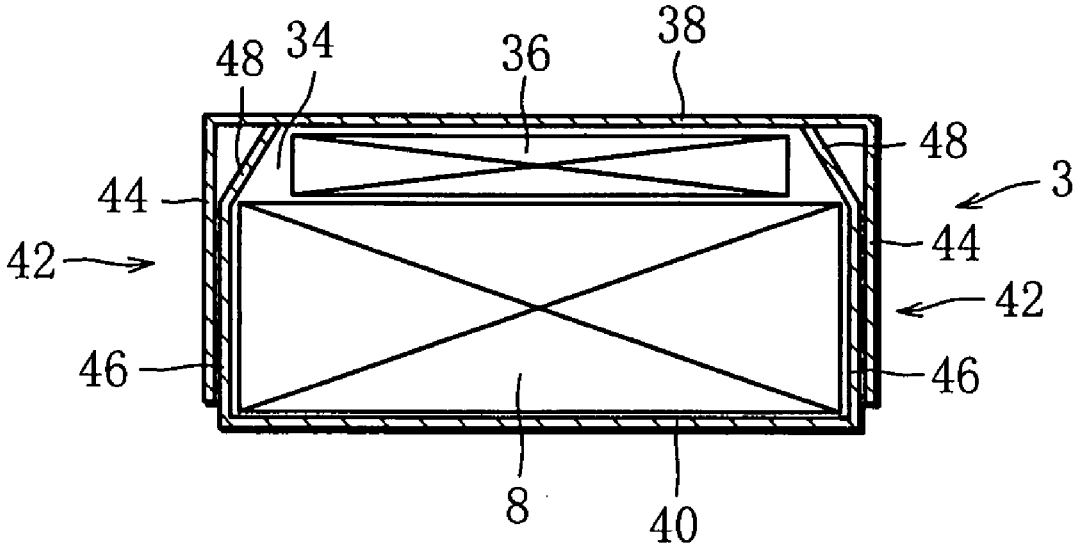
FIG. 4 is a sectional view of the cigarette package of FIG. 1.

FIG. 4 shows a sectional structure of the inner blank 11. The inner blank 11 includes a base layer 14 made of paper, which is located in the middle, an aluminum layer 16 as a metal layer and a resin layer 18 which are superposed upon each side of the base layer 14 with an adhesive agent (not shown), interposed therebetween. The resin layer 18 is made of polypropylene (PP). The aluminum layer 16 has a function of shielding the aroma and flavor components released from the cigarette bundle, whereas the resin layer 18 serves as a heat seal layer.

As is apparent from FIG. 2, the inner box 8 includes a box body 20 having an opening at an upper end thereof and a tongue lid 22 for opening/closing the opening of the box body 20. Concretely, the tongue lid 22 has a lid portion 24 for covering the opening of the box body 20, a tongue portion 26 extending from a front edge of the lid portion 24, for covering an upper portion of a front wall 20*f* of the box body 20, and a rear wall portion 28 extending from a rear edge of the lid portion 24 and connected to a rear wall 20*r* of the box body 20 through the self hinge. The tongue lid 22 rotates around the self hinge, to thereby open/close the opening of the box body 20.

After the inner box 8 is fabricated, the tongue lid 22 is detachably heat-sealed to the box body 20. More specifically, the tongue portion 26, the lid portion 24 and the rear wall portion 28 of the tongue lid 22 are detachably heat-sealed to the front wall 20*f* of the box body 20, right and left inner top flaps 30 of the box body 20, and right and left side walls of the box body 20, respectively. Hatching in FIG. 2 indicates areas in which the tongue lid 22 is detachably heat-sealed.

The right and left side walls of the box body 20 are formed by superposing inner side flaps and outer side flaps of the inner blank upon each other and undetachably heat-sealing these flaps to each other. The bottom wall of the casing body 20 is formed by superposing a bottom panel and right and left inner bottom flaps of the inner blank upon each other and undetachably heat-sealing the panel and flaps to each other.

As is clear from FIG. 2, the front wall 20*f* of the box body 20 has a U-shaped aperture 32 in the upper portion thereof. When the inner box 8 is fabricated, and the tongue portion 26 is heat-sealed to the front wall 20*f* of the box body 20, the aperture 32 is air-tightly closed by the tongue portion 26.

As is evident from FIG. 1, the outer box 2 further includes a containing space 34 secured in between the outer box 2 and the inner box 8. Disposed in the containing space 34 is a printed material 36 as a printed article. The printed material 36 is, for example, a printed sheet in a folded state. The sheet is printed with desired information in ink on one or both sides thereof. To be more precise, the printed material 36 is advertising media, an explanatory note about smoking, a coupon or the like. According to the present embodiment, the printed material 36 has the same height as the inner box 8 or is slightly lower than the inner box 8. The printed material 36 is smaller than the inner box 8 in width.

As illustrated in FIG. 4, the box body 3 of the outer box 2 has a front wall 38, a rear wall 40, right and left side walls 42, and a bottom wall. Each of the side walls 42, as mentioned above, has a double structure including an outside part 44 and an inside part 46. The containing space 34 is defined by the front wall 38, the inside parts 46 of the side walls 42, the bottom wall, and a front face of the inner box 8. More specifically, the containing space 34 is secured in the outer box 2 at the same time when the outer box 2 is formed by folding the outer blank for the outer casing 2 around the inner box 8 and the printed material 36.

In order to enable the fabrication of the outer box 2 with the containing space 34 by folding the outer blank, each of the inside parts 46 of the side walls 42 has a bent portion 48. The bent portions 48 are bent toward the printed material 36.

Figure 5:
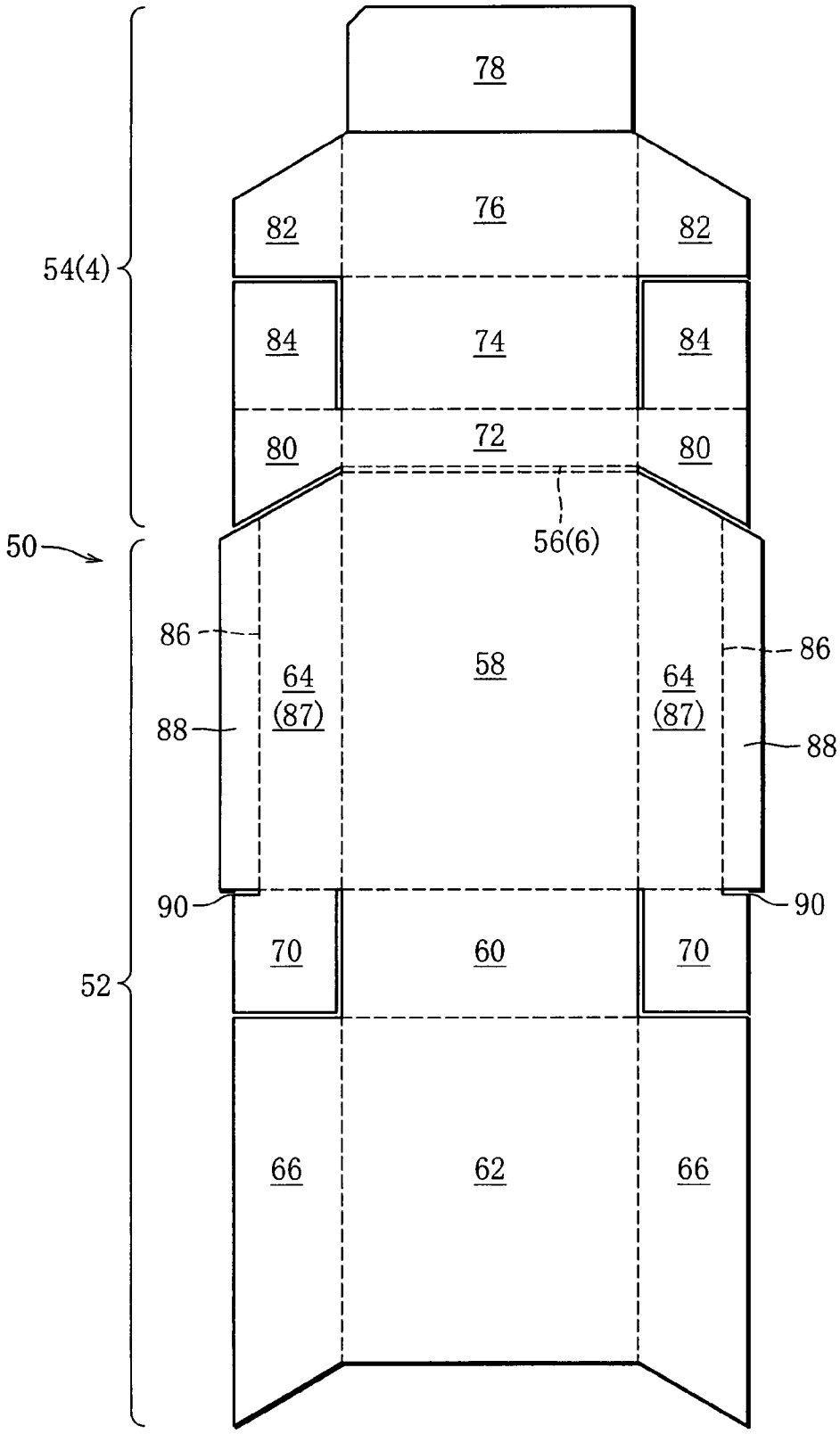
FIG. 5 is a developed view of an outer blank for forming an outer casing of FIG. 1.

FIG. 5 indicates an outer blank 50 for the outer box 2. Desired information is printed on an outer surface of the outer blank 50.

The outer blank 50 includes a main section 52 for forming the box body 3 of the outer box 2 and a subsection 54 for forming the lid 4 of the outer box 2. The main section 52 and the subsection 54 are connected to each other through a fold line 56 shown by a double-dashed line, which functions as the self hinge 6. The sections 52 and 54 each have a plurality of panels and flaps demarcated by fold lines shown by dashed lines.

The main section 52 and the subsection 54 have the same layout of the panels and flaps as an outer blank for forming an ordinary hinge-lid outer box. Therefore, the sections 52 and 54 will be briefly described here.

The main section 52 includes a rear panel 58. The rear panel 58 has an upper edge formed as the fold line 56. A bottom panel 60 and a front panel 62 are connected in this order to a lower edge of the rear panel 58 through fold lines. The rear panel 58, the bottom panel 60, and the front panel 62 form the rear wall 40, a part of the bottom wall, and the front wall 38, respectively, of the box body 3 (see FIG. 1).

A pair of inner side flaps 64 and a pair of outer side flaps 66 are connected through fold lines to right and left sides of the rear panel 58 and those of the front panel 62, respectively. The inner side flaps 64 and the outer side flaps 66 form the side walls 42. In other words, the inner side flaps 64 form the inside parts 46 of the side walls 42, whereas the outer side flaps 66 form the outside parts 44 of the side walls 42.

Inner bottom flaps 70 are located in both sides of the bottom panel 60. The inner bottom flaps 70 are connected to lower edges of the respective inner side flaps 64 through fold lines, and form the bottom wall of the box body 3 in cooperation with the bottom panel 60.

The sub section 54 includes a rear panel 72. The rear panel 72 has a lower edge as the fold line 56. The rear panels 72 and 58 are arranged with the fold line 56 interposed therebetween.

A top panel 74, a front panel 76, and an inner front flap 78 are connected in this order to an upper edge of the rear panel 72 through fold lines. The rear panel 72 and the top panel 74 form a part of rear and upper walls of the lid 4. The front panel 76 and the inner front flap 78 forms a front wall of the lid 4.

A pair of inner side flaps 80 and a pair of outer side flaps 82 are connected through fold lines to right and left sides of the top panel 74 and those of the front panel 76, respectively. The inner side flaps 80 and the outer side flaps 82 form side walls of the lid 4.

Inner top flaps 84 are arranged on both sides of the top panel 74. The inner top flaps 84 are connected to upper edges of the respective inner side flaps 80 through fold lines, and form the upper wall of the lid 4 in cooperation with the top panel 74.

Needless to say, the panels and flaps of the outer blank 50 have sufficient size for containing the inner box 8 with the printed material 36. However, the outer blank 50 differs from an outer blank for an ordinary hinge-lid outer box in the following points.

First, as is obvious from FIG. 5, the inner side flaps 64 have larger width than the vertically adjacent flaps 66, 70, 80, 82 and 84. The flaps 66, 70, 80, 82 and 84 have are identical in width.

Each of the inner side flaps 64 has a fold line 86 shown by a dashed line. The fold lines 86 are located closer to the rear panel 58 than to outer edges of the flaps 66, 70, 80, 82 and 84. Each of the fold lines 86 divides the corresponding inner side flap 64 into an inside portion 87 located on the rear panel 58 side and an outside portion 88 for forming the bent portion 48.

The fold lines 86 are formed of impression lines similar to the other fold lines of the outer blank 50, which demarcate the panels and the flaps. The fold lines 86 make it easy to fold the outside portions 88 toward a inner side of the outer blank 50. As is apparent from FIG. 4, each of the inside portions 87 has width that is virtually equal to thickness of the inner box 8. The width of the flaps 66, 70, 80, 82 and 84 is virtually equal to the total thickness of the inner box 8 and the printed material 36.

Formed between lower edges of the outside portions 88 and the inner bottom flaps 70 are cuts 90 for separating the outside portions 88 from the inner bottom flaps 70. Upper edges of the outside portions 88 form extended portions of slanted edges of the inner side flaps 64. Additionally, as is clear from FIG. 5, the inner and outer side flaps 80 and 82 of the subsection 54 also have slanted edges corresponding to the slanted edges of the inner side flaps 64.

The outer blank 50 is folded around the inner box 8 and the printed material 36 in the same steps as in the case of an outer blank for forming an ordinary hinge-lid outer box.

To be concrete, the inner box 8 with the printed material 36 is supplied onto the inner side of the outer blank 50, so that the inner box 8 is superposed upon the rear panels 58 and 72 of the outer blank 50. The printed material 36 is placed in the center of the front face of the inner box 8, that is, as is obvious from FIG. 1, so as to extend from the tongue portion 26 of the inner box 8 to a front face of the box body 20.

In this state, the right and left inner side flaps 64 and the right and left inner side flaps 80 are folded toward both side faces of the inner box 8. The inner front flap 78 is folded simultaneously with the folding of the flaps 64 and 80. The inner front flap 78 is superposed upon the front panel 76, to thereby form the front wall of the lid 4. Subsequently, the inner bottom flaps 70 and the inner top flaps 84 are folded toward the bottom and the upper face of the inner box 8, respectively.

In the next place, the bottom panel 60 is folded toward the bottom of the inner box 8 and is bonded to the right and left inner bottom flaps 70. At the same time as the folding of the bottom panel 60, the top panel 74 is folded toward the upper face of the inner box 8 and is bonded to the inner top flaps 84.

Figure 6:
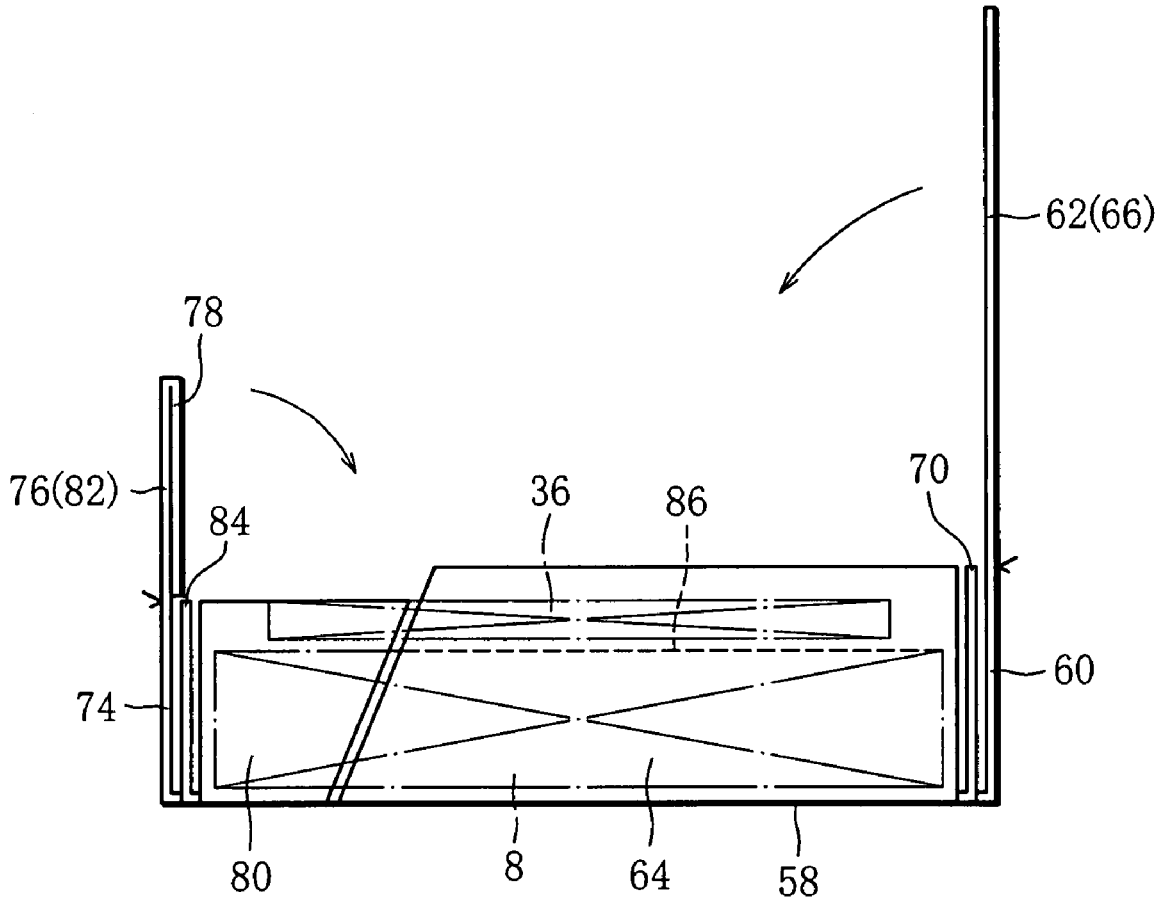
FIG. 6 is a view showing a process of folding the outer blank of FIG. 5.

At this point, the outer blank 50 is in a state shown in FIG. 6. The front panel 62 with the outer side flaps 66 upwardly extends from the bottom panel 60. The front wall (the front panel 76 and the inner front flap 78) of the lid 4 with the outer side flaps 82 upwardly extends from the top panel 74.

V-shaped marks in FIG. 6 indicate the fold line between the front panel 62 and the bottom panel 60 and that between the front panel 76 and the top panel 74. The fold lines indicated by the V-shaped marks coincide with the upper edges of the inner bottom flaps 70 and the inner top flaps 84. That is to say, in the state shown in FIG. 6, the inner bottom flaps 70 and the bottom panel 60 are bonded to each other, thereby forming a strong support wall (the bottom wall of the box body 3). At the same time, the inner top flaps 84 and the top panel 74 are also bonded to each other, thereby forming a strong support wall (the upper wall of the lid 4).

Consequently, when the front panel 62 and the front walls (76 and 78) of the lid 4 are folded toward the printed material 36 placed on the inner box 8 in a direction of arrows in FIG. 6 from the state shown in FIG. 6, the front panel 62 and the front walls (76 and 78) are reliably folded along upper edges of the respective support walls, namely the respective folded lines (indicated by the V-shaped marks).

Figure 7:
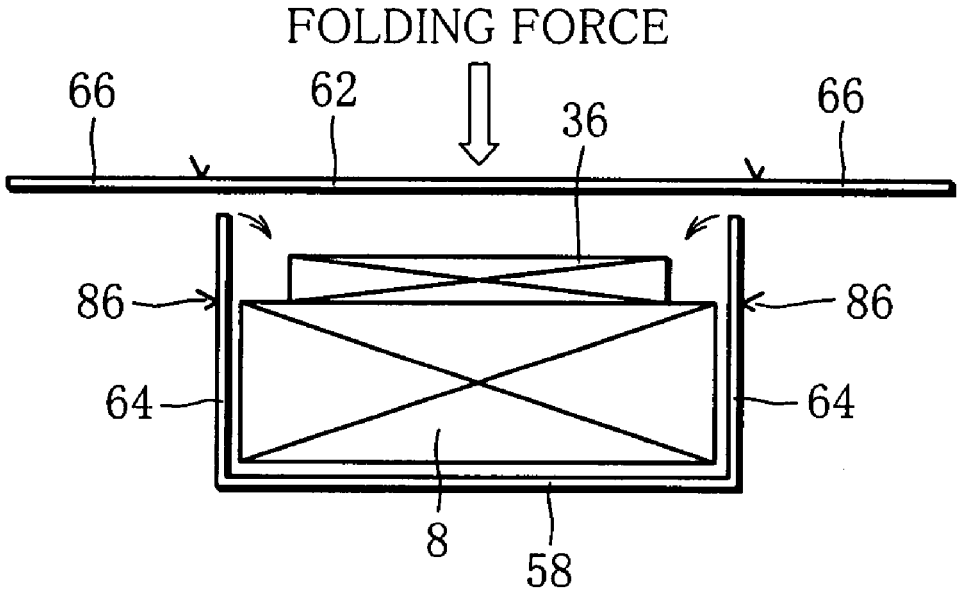
FIG. 7 is a view showing the folding of the outer blank from the state shown in FIG. 6.

In the state of FIG. 6, the outside portions 88 of the right and left inner side flaps 64 are upwardly protruding from the printed material 36. The outside portions 88 are separated from the inner bottom flaps 70 due to the cuts 90. Therefore, when the front panel 62 is folded, as is evident from FIG. 7, the front panel 62 is brought into contact with the right and left outside portions 88 before contacting the printed material 36, and causes the outside portions 88 to bend along the fold line 86 in a direction of arrows shown in FIG. 7, or toward the printed material 36. The front panel 62 is then placed on the printed material 36 to be brought into tight contact with the printed material 36. At this point, the bent portion 48 is formed (see FIG. 4).

The right and left inner side flaps 80 are not protruding from the printed material 36 in the upward direction. Accordingly, the front walls (76 and 78) of the lid 4 are placed on the printed material 36 without interfering with the inner side flaps 80, thereby being brought into tight contact with the printed material 36.

Thereafter, the right and left outer side flaps 66 of the front panel 62 and the right and left outer side flaps 82 of the front panel 76 are folded toward the respective inner side flaps 64 and 80. In so doing, the outer side flaps 66 and 82 are surely folded along the fold lines since the front panels 62 and 76 are supported while in tight contact with the printed material 36. The outer side flaps 66 and 82 are superposed upon the respective inner side flaps 64 and 80, and are bonded to each other to form side walls of the outer box 2. At this point, the folding of the outer blank 50 is completed, and the cigarette package shown in FIG. 1 is obtained. Subsequently, the cigarette package is wrapped in a transparent film if necessary.

According to the above-described cigarette package, when the lid 4 of the outer box 2 is opened, the inner box 8 and the printed material 36 are exposed from the opening of the box body 3 as illustrated in FIG. 1. If the printed material 36 is then removed from the box body 3, the tongue portion 26 of the tongue lid 22 of the inner box 8 is fully exposed. In this state, when the tongue lid 22 is opened simultaneously with the peeling of the heat-sealed areas, an upper portion of the inner pack 10 is exposed from the opening of the inner box 8. Thereafter, when a cut-off section of the aluminum-vapor-deposited paper 12 of the inner pack 10 is cut away along the cut-off line, filter cigarettes in the inner pack 10 are exposed as illustrated in FIG. 2 and can be drawn from the inner box 8, or the cigarette package.

Even if the printed material 36 is contained in the outer box 2, the inner pack 10 is sealed in the inner box 8. Therefore, an ink odor emitted from the printed material 36 never permeates the filter cigarettes FC contained in the inner pack 10. Moreover, the aroma and flavor components of the filter cigarettes FC are not released outside the inner box before the tongue lid 22 is first opened. Accordingly, the quality of the filter cigarettes FC is maintained for a long period of time with or without the printed material 36.

Since the printed material 36 is contained in the outer box 2, the printed material 36 does not cover a part of the outer surface of the outer box 2. Therefore, the information printed on the outer surface of the outer box 2 is not hidden by the printed material 36 and is totally recognizable to the consumer.

Since the printed material 36 is a printed sheet in a folded state, it has a sufficient space for printing information to be provided to the consumer.

Furthermore, the containing space 34 is formed while the outer blank 50 is folded, so that it is not required that the containing space 34 be defined by using other members than the outer blank 50 and that a special wrapping apparatus be separately developed. As a result, the present invention can easily provide the outer box 2 that contains the printed material 36 together with the inner box 8, namely the cigarette package.

The present invention is not limited to the one embodiment describe above, and may be modified in various ways.

Figure 8:
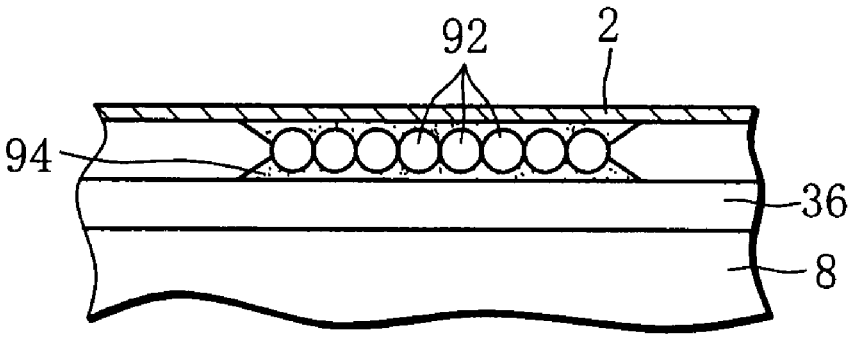
FIG. 8 is a view showing a modification example of the cigarette package.

As illustrated in FIG. 8, the cigarette package may include a lot of aroma capsules 92. The aroma capsules 92 are arranged, for example, between an inner face of the outer box 2 and the printed material 36. The aroma capsules 92 have outer shell and volatile aromatic substances enclosed in the outer shell. The aromatic substances emit, for example, the same aroma and flavor as those of the filter cigarettes FC. When the outer shell of the aroma capsules 92 ruptures, the aroma and flavor components are released from the aroma capsules 92.

To be more specific, it is preferable that the outer shell of the aroma capsules 92 rupture when the printed material 36 is removed from the outer box 2. To this end, the aroma capsules 92 are, for example, bonded both to the inner surface of the outer box 2 and the printed material 36 by using an adhesive agent 94. When the printed material 36 is taken out, the outer shell of the aroma capsules 92 ruptures, and the aroma and flavor components are released from the aroma capsules 92 into the outer box 2. As a result, the consumer can enjoy the aroma and flavor of the filter cigarettes FC before opening the tongue lid 22 of the inner box 8.

The printed material 36 is not necessarily limited to paper printed with something, and various kinds of print media may be used as long as they are printable.

The invention claimed is:

1. A cigarette package comprising:

an inner pack obtained by wrapping a cigarette bundle in an inner wrapping paper;

an openable/closable inner box air-tightly containing said inner pack;

a hinge-lid outer box containing said inner box and defining a containing space between an inner surface of the outer box and said inner box; and printed material disposed in said containing space so as to be removable from said outer box, wherein said outer box includes a box body formed by folding a paper outer blank around said inner box and said printed material, the box body having an opened upper end and a hinge lid for opening/closing the opening of the box body, said box body having a front wall, right and left side walls, a rear wall and a bottom wall; and said containing space is defined by the front wall, the side walls, the bottom wall and a front face of said inner box, each of the side walls being formed into a double structure having an outside part and an inside part; and the inside parts of the side walls have a width larger than that of the outside parts of the side walls to provide bent portions which extend from the side walls to terminate at the front wall of the box body to define said containing space, said bent portions being bent toward said printed article.

2. The cigarette package according to claim 1, wherein: said inner box includes an inner blank folded around said inner pack, said inner blank being capable of heat-sealed and having shielding performance against aroma and flavor components released from the cigarette bundle.

3. The cigarette package according to claim 2, wherein: said inner blank has a shielding layer made of aluminum and resin layers laminated on both sides of the shielding layer, the resin layers being capable of heat sealing.

4. The cigarette package of claim 2, wherein the inner blank comprises a composite of a resin layer, a paper base layer and an aluminum layer disposed therebetween.

5. The cigarette package according to claim 1, wherein: the inside parts further have fold lines for demarcating the respective bent portions, and the bent portions are bent along the fold lines when said outer blank is folded.

6. The cigarette package according to claim 1, wherein:

said package further includes aroma capsules arranged in said containing space, said aroma capsules rupturing when said printed material is removed from said outer box to release aroma and flavor components.

7. The cigarette package according to claim 6, wherein: said aroma capsules are bonded to both the inner surface of said outer box and to said printed material by using an adhesive agent, and the adhesive agent causes said aroma capsules to break when said printed article is removed from said outer box.

8. The cigarette package according to claim 1, wherein: said printed material is printed paper in a folded state.

9. The cigarette package of claim 1, wherein said inner box includes a tongue lid, and said printed material is superposed on a tongue portion of the tongue lid while said printed material is contained in said containing space.

10. The cigarette package or claim 1, wherein the bent portions restrict the inner box to a confined space within the outer box, thereby establishing said containing space.

* * * * *